US010233697B2

(12) United States Patent
Izbinski et al.

(10) Patent No.: US 10,233,697 B2
(45) Date of Patent: Mar. 19, 2019

(54) METHODS OF REDUCING STRESS IN CUTTING ELEMENTS FOR EARTH-BORING TOOLS AND RESULTING CUTTING ELEMENTS

(71) Applicant: Baker Hughes Incorporated, Houston, TX (US)

(72) Inventors: Konrad T. Izbinski, The Woodlands, TX (US); Xu Huang, Spring, TX (US); Anthony A. DiGiovanni, Houston, TX (US); Marc W. Bird, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 681 days.

(21) Appl. No.: 14/852,163

(22) Filed: Sep. 11, 2015

(65) Prior Publication Data

US 2017/0074046 A1 Mar. 16, 2017

(51) Int. Cl.
*B24D 18/00* (2006.01)
*E21B 10/573* (2006.01)

(52) U.S. Cl.
CPC ..... *E21B 10/5735* (2013.01); *B24D 18/00* (2013.01)

(58) Field of Classification Search
CPC ..... E21B 10/46; E21B 10/5735; B01J 3/06; B24D 18/00
See application file for complete search history.

(56) References Cited

U.S. PATENT DOCUMENTS

| | | | | |
|---|---|---|---|---|
| 8,267,204 | B2 | 9/2012 | Lyons | |
| 8,475,918 | B2 | 7/2013 | DiGiovanni et al. | |
| 8,702,825 | B2 | 4/2014 | Shen et al. | |
| 8,757,299 | B2 | 6/2014 | DiGiovanni et al. | |
| 8,882,869 | B2 | 11/2014 | DiGiovanni et al. | |
| 2011/0024200 | A1 | 2/2011 | DiGiovanni et al. | |
| 2011/0067930 | A1 | 3/2011 | Beaton | |
| 2011/0073379 | A1 | 3/2011 | DiGiovanni et al. | |
| 2012/0080239 | A1* | 4/2012 | Lyons | B24D 99/005 175/428 |
| 2012/0225253 | A1* | 9/2012 | DiGiovanni | F16C 33/043 428/161 |
| 2014/0223836 | A1 | 8/2014 | Shen et al. | |
| 2014/0299387 | A1 | 10/2014 | DiGiovanni et al. | |
| 2015/0053486 | A1 | 2/2015 | DiGiovanni et al. | |

OTHER PUBLICATIONS

Thermal Properties of Metals, Chapter 2 "Thermal Expansion", ASM International (Jan. 1, 2002) pp. 9-16.

(Continued)

*Primary Examiner* — Pegah Parvini
(74) *Attorney, Agent, or Firm* — TraskBritt

(57) ABSTRACT

Cutting elements for earth-boring tools may include a superhard, polycrystalline material and a substrate adjacent to and secured to the superhard, polycrystalline material at an interface. The substrate may include a first region exhibiting a first coefficient of thermal expansion and a second region exhibiting a second, different coefficient of thermal expansion. The first region may be spaced from the superhard, polycrystalline material. The second region may extend from laterally adjacent to at least a portion of the first region to longitudinally between the first region and the superhard, polycrystalline material.

20 Claims, 11 Drawing Sheets

(56) References Cited

OTHER PUBLICATIONS

BAL Seal Engineering, Technical Report, Coefficient of Termal Expansion for Various Materials at Different Temperatures, Jun. 25, 2004, 6 pages.
Dornfeld, W.H., Thick-Walled Cylinders and Press Fits, PressCylinder, (2004), pp. 1-17.
Hidnert, Peter, THermal Expansion of Cemented Tungsten Carbide, U.S. Department of Commerce, National Bureau of Standards, Part of Journal of Research of the National Bureau of Standards, vol. 18, Jan. 1937, pp. 47-52.

* cited by examiner

METHODS OF REDUCING STRESS IN CUTTING ELEMENTS FOR EARTH-BORING TOOLS AND RESULTING CUTTING ELEMENTS

FIELD

This disclosure relates generally to cutting elements for earth-boring tools. More specifically, disclosed embodiments relate to methods of making cutting elements for earth-boring tools that may result in reduced detrimental stresses in the cutting elements.

BACKGROUND

Cutting elements secured to earth-boring tools may include a substrate of a hard material secured to a cutting surface of a superhard material. For example, a cutting element for an earth-boring tool may include a cylindrical metal-matrix-cemented tungsten carbide substrate and a table of polycrystalline diamond material, also known in the art as a polycrystalline diamond compact (PDC) secured to the substrate. The substrate and PDC may exhibit significantly different coefficients of thermal expansion. As a result, such cutting elements may exhibit significant, undesirable residual stresses, particularly in the diamond table and proximate the interface between the diamond table and the substrate, resulting from the differences in thermally induced expansion and contraction between the substrate and PDC that may occur during formation of the PDC material and attachment of the cutting element to an earth-boring tool. Residual stresses may cause the cutting element to fail prematurely.

BRIEF SUMMARY

In some embodiments, cutting elements for earth-boring tools may include a superhard, polycrystalline material and a substrate adjacent to and secured to the superhard, polycrystalline material at an interface. The substrate may include a first region exhibiting a first coefficient of thermal expansion and a second region exhibiting a second, different coefficient of thermal expansion. The first region may be spaced from the superhard, polycrystalline material. The second region may extend from laterally adjacent to at least a portion of the first region to longitudinally between the first region and the superhard, polycrystalline material.

In other embodiments, methods of forming cutting elements for earth-boring tools may involve forming a recess in a substrate at a first region positioned to be spaced from a superhard, polycrystalline material when the superhard, polycrystalline material is adjacent to and secured to the substrate at an interface, to leave a second region of the substrate. The second region may extend laterally outward from a longitudinal axis of the substrate and longitudinally toward and laterally adjacent to the first region proximate at least a portion of a periphery of the substrate. The superhard, polycrystalline material may be secured to the substrate on a side of the substrate opposite the recess.

BRIEF DESCRIPTION OF THE DRAWINGS

While this disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

The illustrations presented in this disclosure are not meant to be actual views of any particular apparatus or component thereof, but are merely idealized representations employed to describe illustrative embodiments. Thus, the drawings are not necessarily to scale.

Disclosed embodiments relate generally to apparatuses that may do this inventive thing or include this inventive material or feature. More specifically, disclosed are embodiments of apparatuses that may achieve this inventive result.

Although some embodiments of cutting elements in this disclosure are depicted as being used and employed in earth-boring drill bits, such as fixed-cutter earth-boring rotary drill bits, sometimes referred to as "drag" bits, persons of ordinary skill in the art will understand that cutting elements in accordance with this disclosure may be employed in any earth-boring tool employing a structure comprising a superhard, polycrystalline material attached to a supporting substrate. Accordingly, the terms "earth-boring tool" and "earth-boring drill bit," as used in this disclosure, mean and include any type of bit or tool used for drilling during the formation or enlargement of a wellbore in a subterranean formation and include, for example, rolling cone bits, percussion bits, core bits, eccentric bits, bicenter bits, reamers, mills, hybrid bits, and other drilling bits and tools known in the art.

As used in this disclosure, the term "superhard material" means and includes any material having a Knoop hardness value of about 3,000 Kgf/mm$^2$ (29,420 MPa) or more. Superhard materials include, for example, diamond and cubic boron nitride. Superhard materials may also be characterized as "superabrasive" materials.

As used in this disclosure, the term "polycrystalline material" means and includes any structure comprising a plurality of grains (i.e., crystals) of material that are bonded directly together by inter-granular bonds. The crystal structures of the individual grains of the material may be randomly oriented in space within the polycrystalline material. Polycrystalline materials include, for example, polycrystalline diamond (PCD) and polycrystalline cubic boron nitride (CBN).

As used in this disclosure, the terms "interbonded" and "inter-granular bond" means and includes any direct atomic bond (e.g., covalent, ionic, metallic, etc.) between atoms in adjacent grains of superabrasive material.

Figure 1:
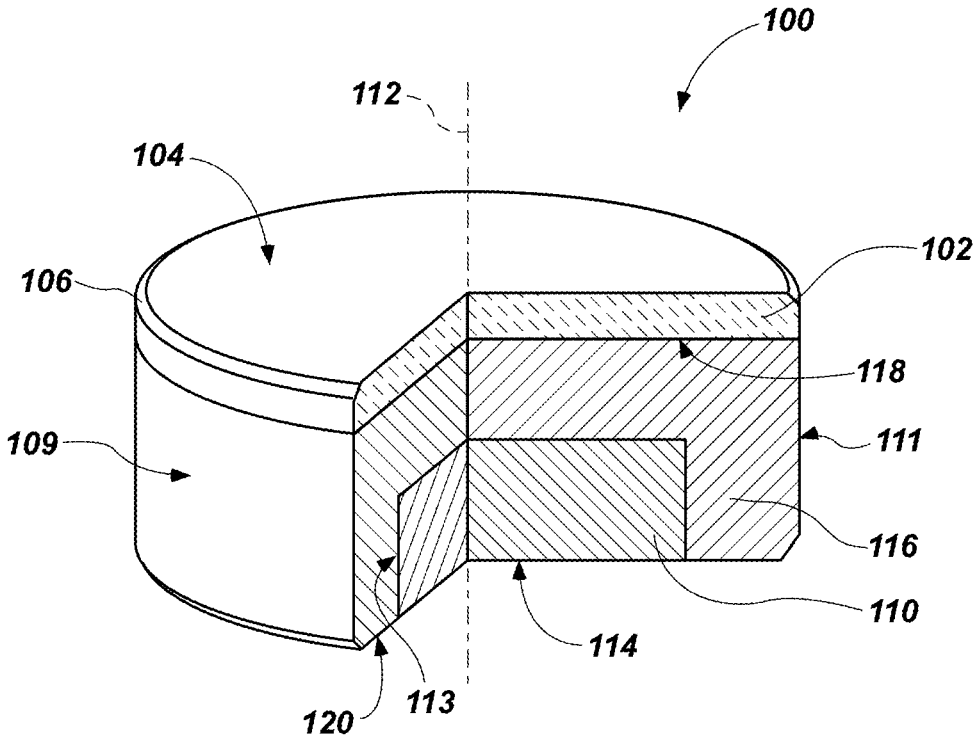
FIG. 1 is a partial cut-away perspective view of a cutting element for an earth-boring tool.

Referring to FIG. 1, a partial cut-away perspective view of a cutting element 100 for an earth-boring tool is shown. The cutting element 100 may include a superhard, polycrystalline material 102 positioned and configured to engage with an underlying earth formation. The superhard, polycrystalline material 102 may be configured as, for example, a disc or tablet, and is commonly referred to in the art as a "table." More specifically, the superhard, polycrystalline material 102 may be, for example, a thin, substantially cylindrical mass of material. The superhard, polycrystalline material 102 may be characterized by, for example, a network of grains of superhard material directly interbonded to one another. An interconnected network of interstitial spaces may be interspersed among the grains of superhard material. The interstitial spaces may or may not be occupied by a solvent catalyst material, such as, for example, a Group VIII metal or metal alloy (e.g., iron, cobalt, nickel, alloys thereof), used to facilitate formation of the polycrystalline material during a high pressure, high temperature sintering process. For example, at least a cutting face 104 of the superhard, polycrystalline material 102 positioned to directly engage with an underlying earth material may lack solvent catalyst material in the interstitial spaces proximate the cutting face 104, and at least a portion of the superhard, polycrystalline material 102 distal from the cutting face 104 may include solvent catalyst material in the interstitial spaces thereof. In some embodiments, the superhard, polycrystalline material 102 may include a chamfer 106 defining a cutting edge at a periphery 109 of the cutting element 100.

The superhard, polycrystalline material 102 may be secured to a substrate 108. In some embodiments, such as that shown in FIG. 1, the substrate 108 may include multiple portions exhibiting different coefficients of thermal expansion. For example the substrate 108 may include a first region 110 spaced from the superhard, polycrystalline inalerial 102. The first region 110 may be located on a side of the cutting element 100 opposite the upper superhard, polycrystalline material 102 (e.g., a side positioned to rotationally lead when the cutting element 100 is secured to an earth-boring tool, and the earth-boring tool rotates to engage with an underlying earth formation). In addition, at least a portion of the first region 110 may be spaced from a lateral periphery 109 of the cutting element 100. For example, at least a portion of the first region 110 may extend from a longitudinal axis 112 (e.g., an axis at a geometric center of the substrate 108 and positioned to extend through the superhard, polycrystalline material 102) of the substrate 108 to a lateral position spaced from the lateral periphery 109 of the substrate 108. In some embodiments, a surface 114 of the first region 110 may be exposed at a rearmost side of the substrate 108. Although the first region 110 is depicted as a single, contiguous mass concentrated together in a single portion of the substrate 108, the first region 110 may be discontinuously distributed within the substrate 108, such as, for example, in the form of a series of pillars extending into the substrate 108, the series of pillars being spaced from the lateral periphery 109 of the substrate 108 and from the superhard, polycrystalline material 102.

A second region 116 of the substrate 108 may be interposed between the first region 110 and the superhard, polycrystalline material 102 and between at least a portion of the first region 110 and the lateral periphery 111 of the substrate 108. For example, the second region 116 may extend along the longitudinal axis 112 from an upper surface 118 of the substrate 108 (e.g., a surface 118 defining an interface between the substrate 108 and the superhard, polycrystalline material 102) to the first region 110 and laterally to a periphery 111 of the substrate 108. The second region 116 may further extend longitudinally from the upper surface 118 to a rearmost surface 120 of the substrate 108 (e.g., a surface 120 positioned to rotationally trail when the cutting element 100 is secured to an earth-boring tool, and the earth-boring tool rotates to engage with an underlying earth formation) along at least a portion of the lateral periphery 111 of the substrate 108. In some embodiments, the exposed surface 114 of the first region 110 may be at least substantially coplanar with the rearmost surface 120 of the substrate 108.

A first coefficient of thermal expansion of the first region 110 of the substrate 108 may be different from a second coefficient of thermal expansion of the second region 116 of the substrate 108, which may reduce stress within the cutting element 100, may induce a beneficial stress state within the cutting element 100, or both. For example, the first region 110 may exhibit a different material composition from a material composition of the second region 116. As specific, nonlimiting examples, the second region 116 may include a ceramic-metallic composite material (i.e., a cermet) exhibiting a second weight percentage of ceramic particles and a second weight percentage of metal or metal alloy matrix material and the first region 110 may include aluminum, copper, nickel, a metal alloy comprising aluminum, copper, or nickel, or a ceramic-metallic composite material exhibiting a first, different weight percentage of ceramic particles and a first, different weight percentage of metal or metal alloy matrix.

In some embodiments, the first coefficient of thermal expansion of the first region 110 may be less than the second coefficient of thermal expansion of the second region 116. For example, in embodiments where the first region 110 is formed or filled with material after formation of the second region 116, the first coefficient of thermal expansion of the first region 110 may be less than the second coefficient of thermal expansion of the second region 116. In other embodiments, the first coefficient of thermal expansion of the first region 110 may be greater than the second coefficient of thermal expansion of the second region 116. For example, in embodiments where the first region 110 is formed or filled with material concurrently with or before formation of the second region 116, the first coefficient of thermal expansion of the first region 110 may be greater than the second coefficient of thermal expansion of the second region 116.

In some embodiments, the ceramic-metallic composite material of the second region 116 and optionally of the first region 110 may include, for example, ceramic particles of tungsten carbide in a metal or metal alloy matrix that acts as a solvent catalyst material for the superhard, polycrystalline material 102. In embodiments where the second region 116 includes a ceramic-metallic composite material exhibiting a second weight percentage of ceramic particles and a second weight percentage of metal or metal alloy matrix material and the first region 110 includes a ceramic-metallic composite material exhibiting a first, different weight percentage of ceramic particles and a first, different weight percentage of metal or metal alloy matrix, the second weight percentage of matrix material may be, for example, between about 5% and about 30%, and the first weight percentage of matrix material may be, for example, between about 1% and about 40%, with specific values depending on whether it is desired to render the first coefficient of thermal expansion of the first region 100 greater than or less than the second coefficient of thermal expansion of the second region 116.

In embodiments where the first region 110 exhibits a first coefficient of thermal expansion lower than a second coefficient of thermal expansion of the second region 116, the second weight percentage of matrix material may be, for example, between about 5% and about 30%, and the first weight percentage of matrix material may be, for example, between about 1% and about 25%. More specifically, the second weight percentage of matrix material may be, for example, between about 5% and about 30%, and the first weight percentage of matrix material may be, for example, between about 2.5% and about 20%.

In embodiments where the first region 110 exhibits a first coefficient of thermal expansion higher than a second coefficient of thermal expansion of the second region 116, the second weight percentage of matrix material may be, for example, between about 5% and about 30%, and the first weight percentage of matrix material may be, for example, between about 8% and about 40%. More specifically, the second weight percentage of matrix material may be, for example, between about 5% and about 30%, and the first weight percentage of matrix material may be, for example, between about 10% and about 35%.

A percent difference between the first coefficient of thermal expansion of the first region 110 and the second coefficient of thermal expansion of the second region 116, as calculated by subtracting the first coefficient of thermal expansion from the second coefficient of thermal expansion and dividing an absolute value of the result by the second coefficient of thermal expansion, may be, for example, between about 0.01% and about 95%. More specifically, the percent difference between the first coefficient of thermal expansion of the first region 110 and the second coefficient of thermal expansion of the second region 116 may be, for example, between about 1% and about 75%. As specific, nonlimiting examples, the percent difference between the first coefficient of thermal expansion of the first region 110 and the second coefficient of thermal expansion of the second region 116 may be, for example, between about 5% and about 70%, between about 10% and about 60%, or between about 15% and about 50%.

The second coefficient of thermal expansion of the second region 116 may be, for example, between about $6\times10^{-6}$/K and about $17\times10^{-6}$/K. In embodiments where the first coefficient of thermal expansion of the first region 110 is less than the second coefficient of thermal expansion of the second region 116, the first coefficient of thermal expansion of the first region 110 may be, for example, between about $0.5\times10^{-6}$/K and about $16\times10^{-6}$/K. More specifically, the first coefficient of thermal expansion of the first region 110 may be, for example, between about $1\times10^{-6}$/K and about $12\times10^{-6}$/K. As specific, nonlimiting examples, the first coefficient of thermal expansion of the first region 110 may be, for example, between about $2.5\times10^{-6}$/K and about $10\times10^{-6}$/K or between about $4\times10^{-6}$/K and about $8\times10^{-6}$/K. In embodiments where the first coefficient of thermal expansion of the first region 110 is greater than the second coefficient of thermal expansion of the second region 116, the first coefficient of thermal expansion of the first region 110 may be, for example, between about $6.5\times10^{-6}$/K and about $30\times10^{-6}$/K. More specifically, the first coefficient of thermal expansion of the first region 110 may be, for example, between about $8\times10^{-6}$/K and about $25\times10^{-6}$/K. As specific, nonlimiting examples, the first coefficient of thermal expansion of the first region 110 may be, for example, between about $10\times10^{-6}$/K and about $20\times10^{-6}$/K or between about $12\times10^{-6}$/K and about $15\times10^{-6}$/K. As discussed herein, the differences in coefficients of thermal expansion and values for coefficients of thermal expansion are those measurable for a material at atmospheric pressure (e.g., about 100 kPa) and room temperature (e.g., about 20° C.).

Figure 2:
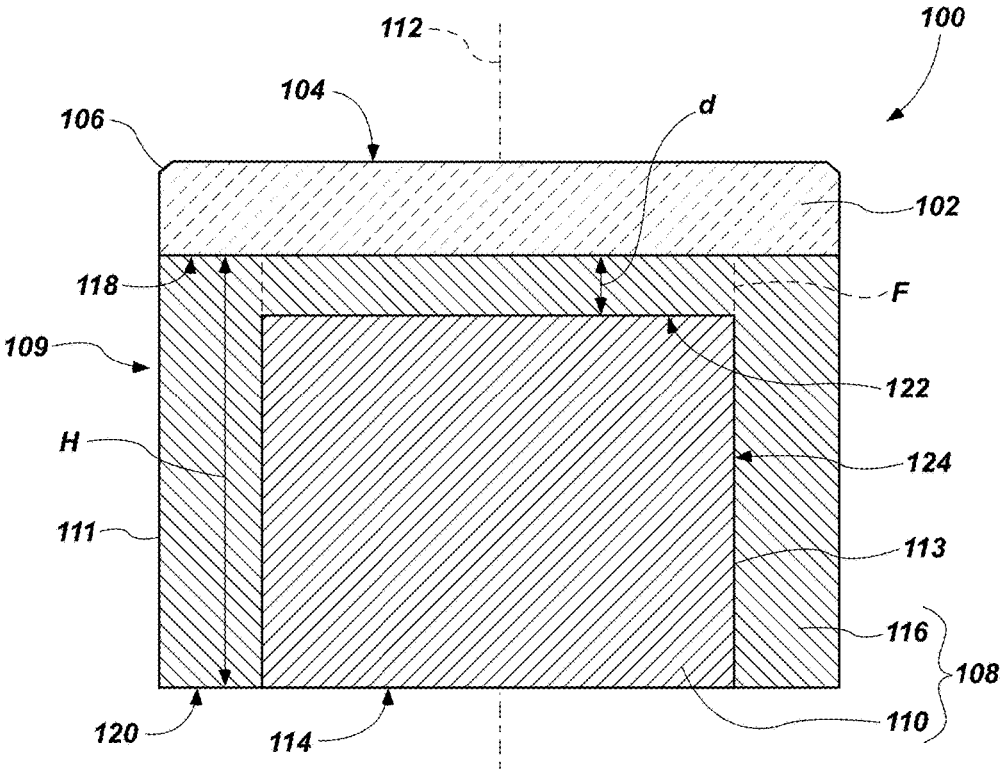
FIG. 2 is a cross-sectional side view of the cutting element of FIG. 1.

FIG. 2 is a cross-sectional side view of the cutting element 100 of FIG. 1. In some embodiments, such as that shown in FIG. 2, a shape of an upper surface 122 of the first region 110 may at least substantially match a shape of the upper surface 118 of the second region 116 at least within a longitudinal footprint F (i.e., a surface area of the upper surface 122 of the first region 110 projected parallel to the longitudinal axis 112 of the substrate 108) of the upper surface 122 of the first region 110. In other words, a topography of a boundary between the first region 110 and the second region 116 extending at least substantially laterally and defined by the upper surface 122 of the first region 110 may be at least substantially the same as a topography of the interface between the superhard, polycrystalline material 102 and the substrate 108 defined by the upper surface 118 of the substrate 108 within the footprint F of the boundary. For example, each of the upper surface 122 of the first region 110 and the upper surface 118 of the second region 116 may be at least substantially planar and may extend at least substantially perpendicular to the longitudinal axis 112 of the substrate 108 and at least substantially parallel to one another.

In some embodiments, a boundary between the first and second regions 110 and 116 may be defined by the upper surface 122 of the first region 110 and a lateral surface 124 of the first region 110. In other embodiments, the boundary between the first and second regions 110 and 116 may not be as clearly demarcated. For example, the boundary may be functionally graded to provide a gradual transition between the material compositions and material properties of the first and second regions 110 and 116.

A distance d between the first region 110 and the superhard, polycrystalline material 102 (e.g., a thickness of the second region 116 between the first region 110 and the superhard, polycrystalline material 102) may be, for example, between about 5% and about 50% of a maximum height H of the substrate 108. More specifically, the distance d between the first region 110 and the superhard, polycrystalline material 102 may be, for example, between about 5.5% and about 25% of the maximum height H of the substrate 108. As a specific, nonlimiting example, the distance d between the first region 110 and the superhard, polycrystalline material 102 may be between about 6% and about 10% of the maximum height H of the substrate 108. The distance d between the first region 110 and the superhard, polycrystalline material 102 may be, for example, about 5 mm or less. More specifically, the distance d between the first region 110 and the superhard, polycrystalline material 102 may be, for example, about 2.5 mm or less. As a specific, nonlimiting example, the distance d between the first region 110 and the superhard, polycrystalline material 102 may be, for example, about 1 mm or less.

Figure 3:
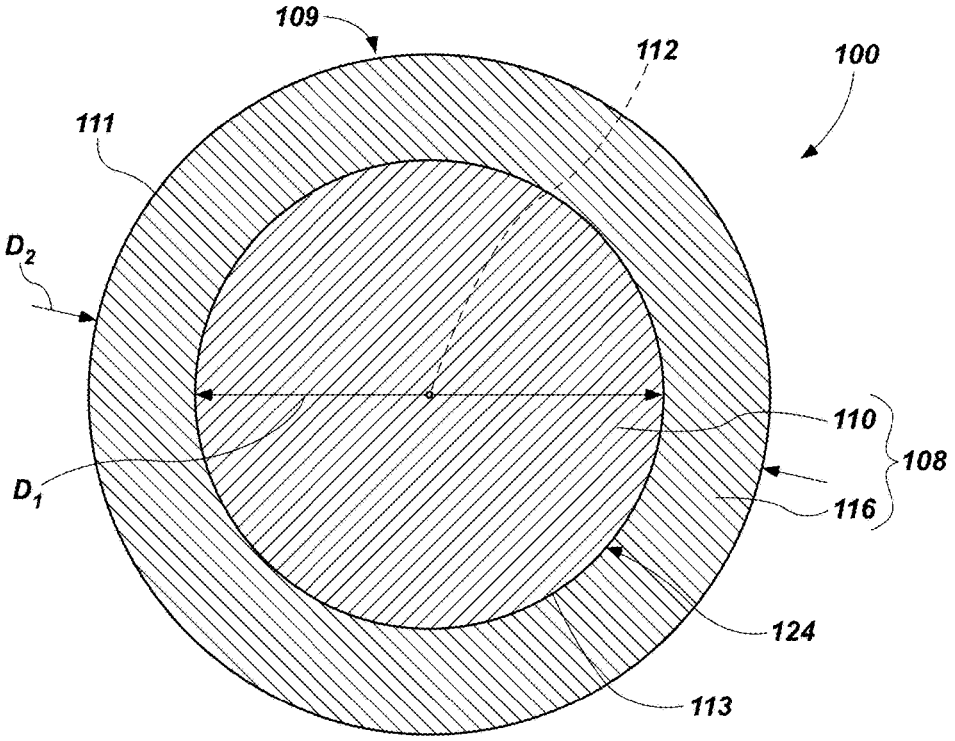
FIG. 3 is a cross-sectional bottom view of the cutting element of FIG. 1.

FIG. 3 is a cross-sectional bottom view of the cutting element 100 of FIG. 1. In some embodiments, such as that shown in FIG. 3, a shape of a lateral periphery 113 of the first region 110 may at least substantially match a shape of a lateral periphery 111 of the substrate 108. For example, a cross-sectional shape of the substrate 108 taken at least substantially perpendicular to the longitudinal axis 112 of the substrate 108 may be at least substantially circular and a cross-sectional shape of the first region 110 taken in the same plane may also be at least substantially circular.

In some embodiments, the second region 116 may laterally surround the first region 110. For example, the lateral surface 124 of the first region 110 may be in contiguous contact with the second region 116. In other words, the second region 116 may be positioned between the first region 110 and a lateral periphery 111 of the substrate 108. The first region 110 may be, for example, geometrically centered within the second region 116 such that the first region 110 may extend laterally from the longitudinal axis 112 to the second region 116 at an at least substantially uniform distance.

In embodiments where the cross-sectional shapes of the first and second regions 110 and 116 are at least substantially circular when viewed from the rearmost surface 120 of the substrate 108, a first diameter $D_1$ of the first region 110 may be less than a second diameter $D_2$ of the second region 116. For example, the first diameter $D_1$ of the first region 110 may be between about 50% and about 80% of the second diameter $D_2$ of the second region 116. More specifically, the first diameter $D_1$ of the first region 110 may be, for example, between about 60% and about 75% of the second diameter $D_2$ of the second region 116. As a specific, nonlimiting example, the first diameter $D_1$ of the first region 110 may be between about 65% and about 72% of the second diameter $D_2$ of the second region 116.

Figure 4:
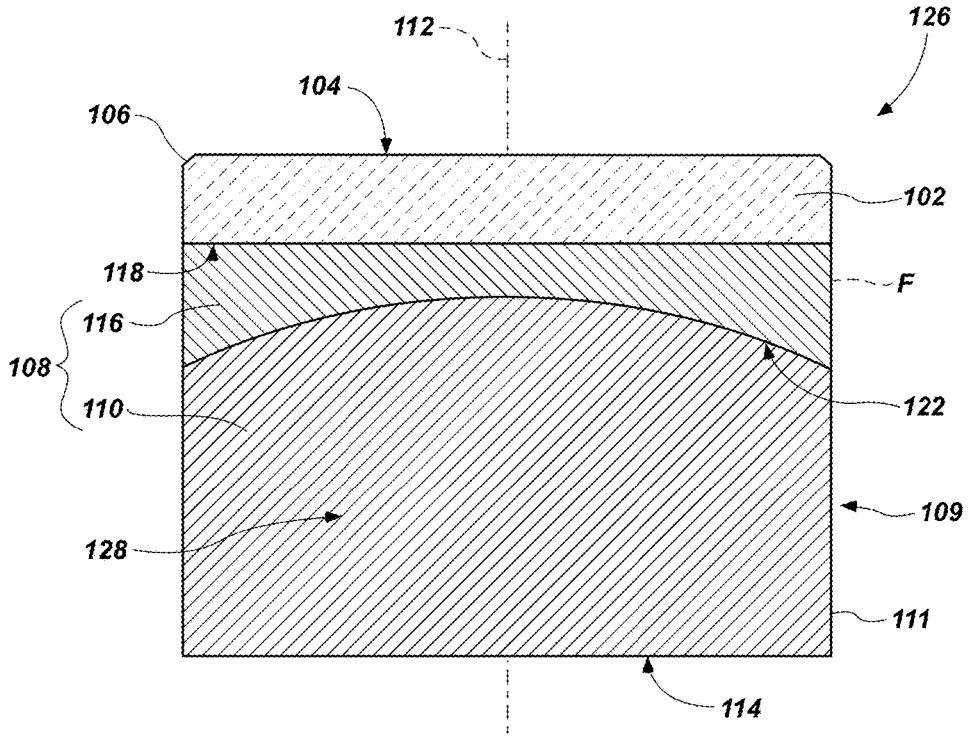
FIG. 4 is a cross-sectional side view of another embodiment of a cutting element.

FIG. 4 is a cross-sectional side view of another embodiment of a cutting element 126. The cutting element 126 may be at least substantially similar to the cutting element 100 of FIGS. 1 through 3, with exceptions discussed as follows. In some embodiments, such as that shown in FIG. 4, one or more surfaces 122 and 124 (see FIG. 5) between the first and second regions 110 and 116 may be nonplanar. In addition, a shape of the upper surface 122 of the first region 110 may be different from a shape of the upper surface 118 of the second region 116. For example, the upper surface 122 of the first region 110 may be arcuate, and the upper surface 118 of the substrate 108 may be at least substantially planar. As other examples, the upper surface 122 of the first region 110 may be at least substantially planar, and the upper surface 118 of the substrate 108 may be nonplanar; or the upper surface 122 of the first region 110 may exhibit a first nonplanar shape, and the upper surface 118 of the substrate 108 may exhibit a second, different nonplanar shape.

Figure 5:
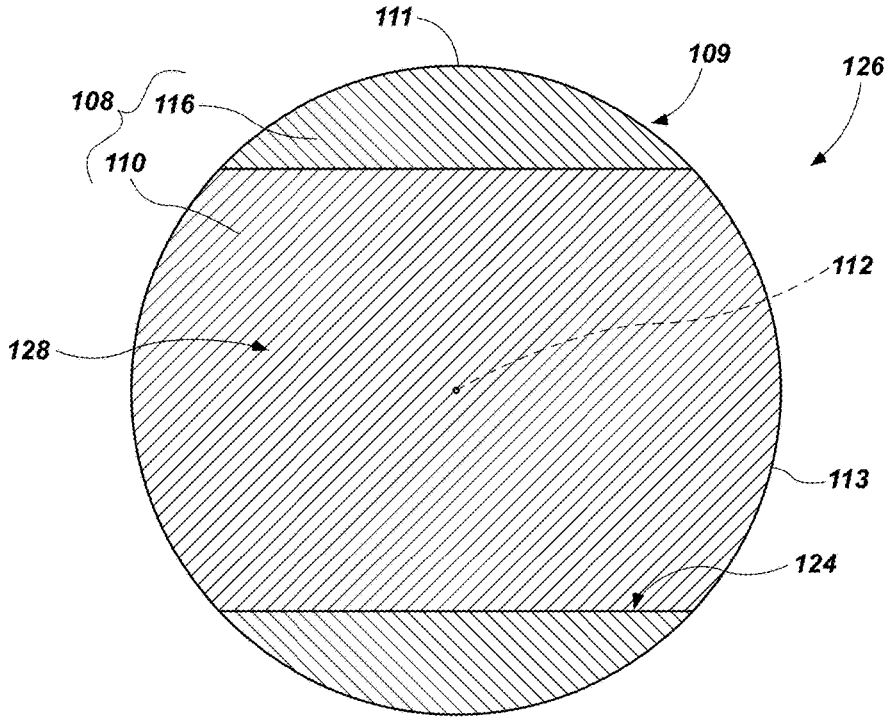
FIG. 5 is a cross-sectional bottom view of the cutting element of FIG. 4.

FIG. 5 is a cross-sectional bottom view of the cutting element 126 of FIG. 4. Referring jointly to FIGS. 4 and 5, the first region 110 may be located in a channel 128 extending laterally through the second region 116. For example, a portion of the first region 110 may be exposed at the lateral periphery 111 of the substrate 108 and another portion of the first region 110 may be in contact with the second region 116, which may be interposed between the first region 110 and the lateral periphery 111 of the substrate 108. More specifically, the first region 110 may be include curved surfaces exposed at the lateral periphery 111 of the substrate 108 on two opposing sides of the substrate 108 and at least substantially straight surfaces in contact with the second region 116 on two other opposing sides of the substrate 108.

Figure 6:
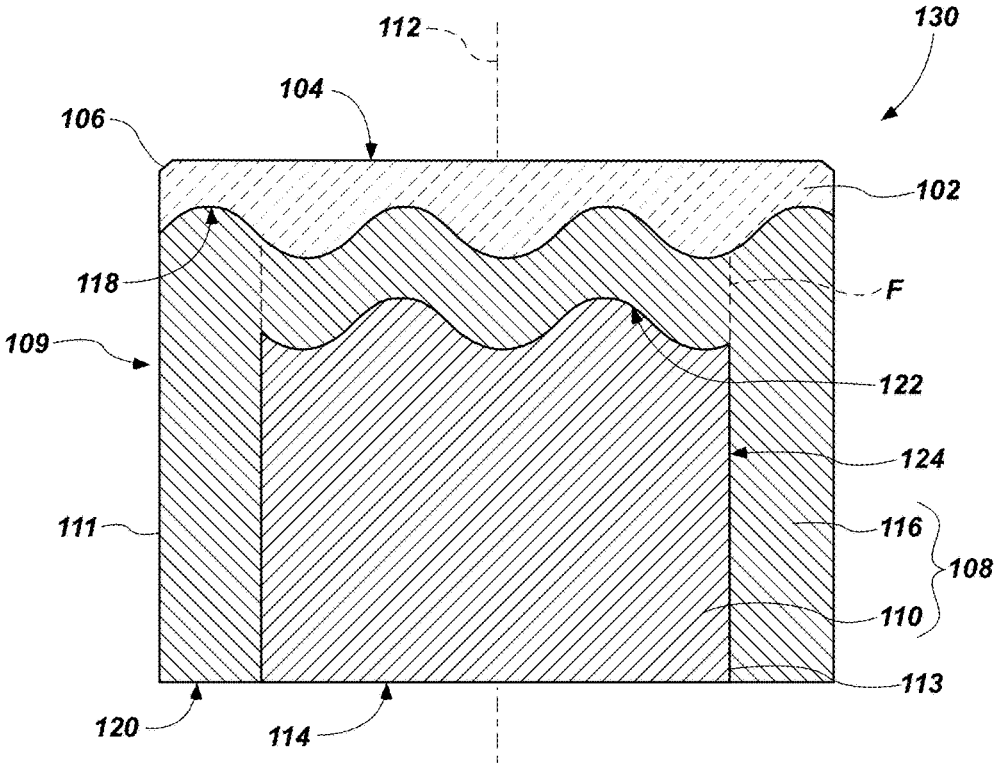
FIG. 6 is a cross-sectional side view of yet another embodiment of a cutting element.

FIG. 6 is a cross-sectional side view of yet another embodiment of a cutting element 130. The cutting element 130 may be at least substantially similar to the cutting element 100 of FIGS. 1 through 5, with exceptions discussed as follows. In some embodiments, such as that shown in FIG. 6, a shape of the upper surface 122 of the first region 110 may at least substantially match a nonplanar shape of the upper surface 118 of the second region 116 at least within the longitudinal footprint F of the upper surface 122 of the first region 110. In other words, a nonplanar topography of a boundary between the first region 110 and the second region 116 extending at least substantially laterally and defined by the upper surface 122 of the first region 110 may be at least substantially the same as a topography of the nonplanar interface between the superhard, polycrystalline material 102 and the substrate 108 defined by the upper surface 118 of the substrate 108 within the footprint F of the upper surface 122 of the first region 110. For example, each of the upper surface 122 of the first region 110 and the upper surface 118 of the second region 116 may exhibit complementary nonplanar topographies.

Figure 7:
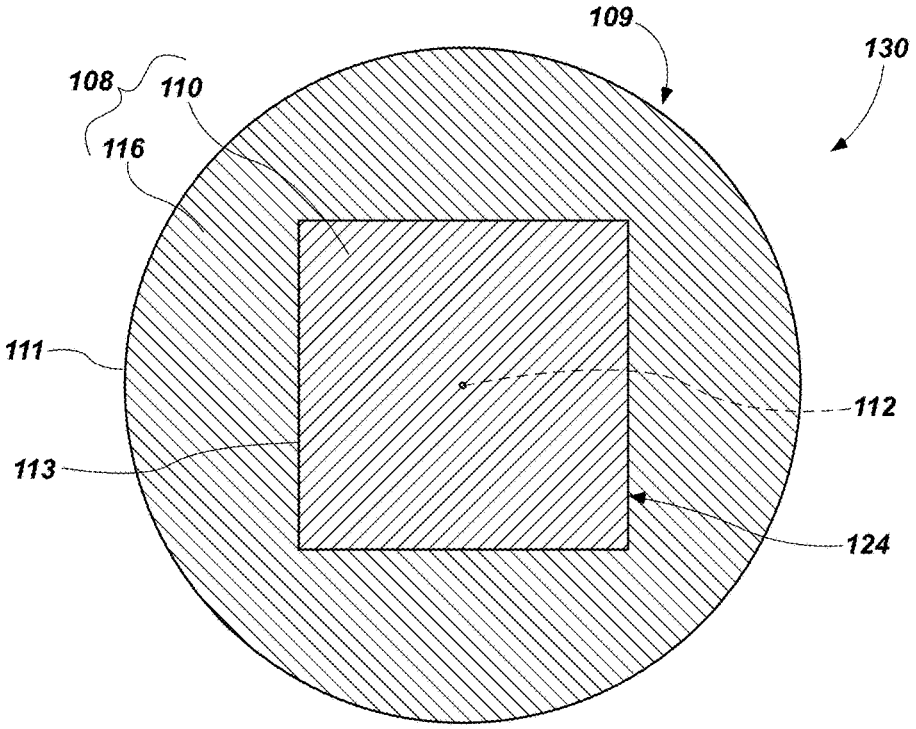
FIG. 7 is a cross-sectional bottom view of the cutting element of FIG. 6.

FIG. 7 is a cross-sectional bottom view of the cutting element 130 of FIG. 6. In some embodiments, such as that shown in FIG. 7, a shape of a lateral periphery 113 of the first region 110 may be different from a shape of a lateral periphery 111 of the second region 116. For example, the lateral periphery 113 of the first region 110 may exhibit a first polygonal shape and the lateral periphery 111 of the second region 116 may exhibit a second, different polygonal shape. As specific, nonlimiting examples, the lateral periphery 113 of the first region 110 may be square, oval, or hexagonal and the lateral periphery 111 of the second region 116 may be circular, elliptical, or oval in a shape that is not complementary to the shape of the first region 110.

Certain, specific embodiments with differing features have been described in connection with FIGS. 1 through 7. As contemplated by the inventors, any feature of any one of the embodiments of FIGS. 1 through 7 may be combined with any feature of any other of the embodiments of FIGS. 1 through 7, so long as those features are not incapable of combination. For example, the matching nonplanar interfaces of FIG. 6 may be combined with the channel of FIG. 5. As another example, the mismatched peripheries of FIG. 7 may be combined with the recess of FIGS. 2 and 3.

Figure 8:
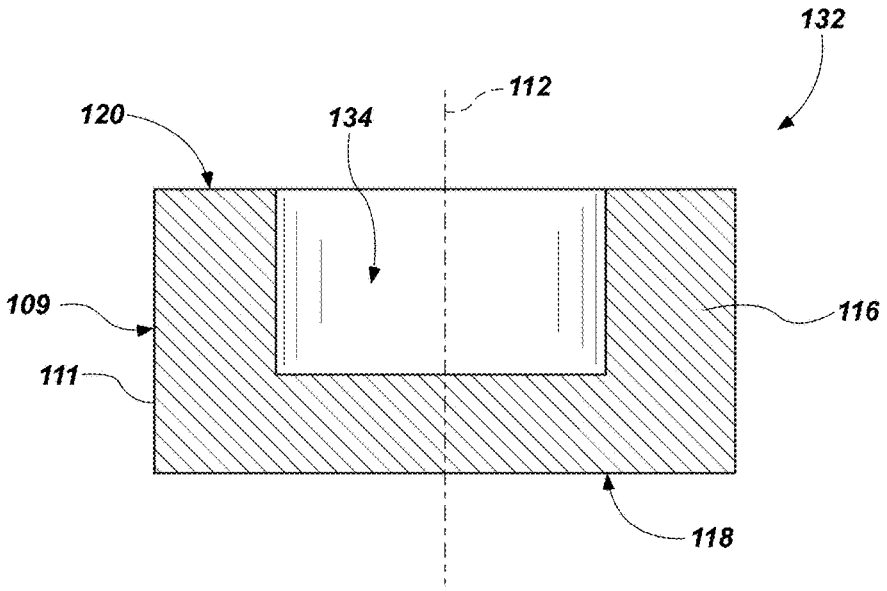
FIG. 8 is a cross-sectional side view of an intermediate structure in a process of forming a cutting element substrate.

FIG. 8 is a cross-sectional side view of an intermediate structure 132 in a process of forming a cutting element substrate 108 (see FIG. 1). The intermediate structure 132 may include the second region 116, which may exhibit an at least substantial "U" shape in at least one lateral cross-section. More specifically, the second region 116 may include an upper portion exhibiting a first surface area at an upper surface 118 of the intermediate structure 132 (i.e., a surface 118 positioned, shaped, and configured for securing a superhard, polycrystalline material 102 (see FIG. 1) to the surface 118) and a second, smaller surface area at a rearmost surface 120 of the intermediate structure 132 (i.e., a rearmost surface positioned to abut against and be secured to an earth-boring tool). The intermediate structure 132 may define a recess 134 extending longitudinally from the rearmost surface 120 toward the upper surface 118 at a radial center of the intermediate structure 132.

In some embodiments, the recess 134 may be formed before the superhard, polycrystalline material 102 is secured to the substrate 108 (see FIG. 1). For example, the intermediate structure 132 may initially be a cylinder of a second material (e.g., cemented tungsten carbide), and the recess 134 may be formed in the intermediate structure 132 by removing material from the rearmost surface 120 toward the upper surface 118 before any superhard, polycrystalline material 102 is secured to the intermediate structure 132. More specifically, the intermediate structure 132 may be formed by electrical discharge machining (EDM), laser drilling, or milling material from a cylinder to form the recess 134 in the intermediate structure 132. In additional embodiments, the recess 134 may be formed during the initial formation of the intermediate structure 132 in, for example, a powder compaction and sintering process. The recess 134 may then be filled with a first material in some embodiments to form the first region 110 (see FIG. 1). A superhard, polycrystalline material 102 may subsequently be secured to the upper surface 118 of the intermediate structure 132, such as, for example, utilizing the processes described in greater detail in connection with FIG. 9. As noted previously, the first material of the first region 110 may exhibit a first coefficient of thermal expansion, and the second material of the second region may exhibit a second, different coefficient of thermal expansion (e.g., a second, higher coefficient expansion), which may reduce the residual stresses induced in the resulting cutting element 100 during formation of the superhard, polycrystalline material 102 and attachment of the resulting cutting element 100 to an earth-boring tool.

Figure 9:
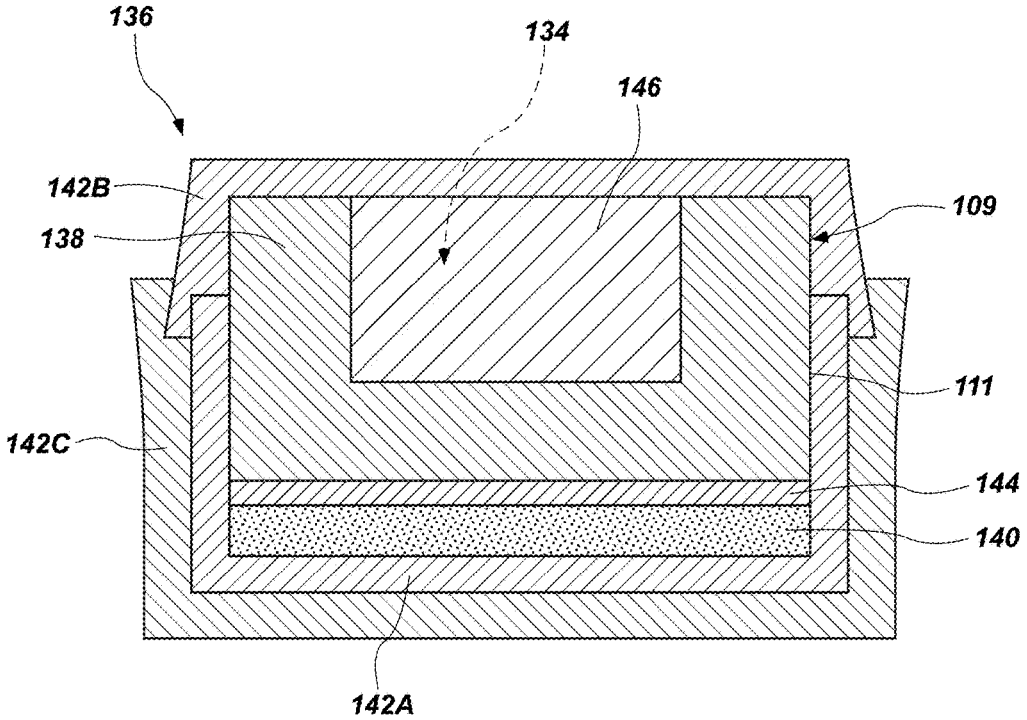
FIG. 9 is a cross-sectional side view of a container for forming a cutting element.

FIG. 9 is a cross-sectional side view of a container 136 for forming a cutting element 100 (see FIG. 1). The container 136 may include an inner cup 142A exhibiting an inverse shape of the cutting element 100 (see FIG. 1). The container 136 may include a top end piece 142B and a bottom end piece 142C, which may be assembled and bonded together (e.g., swagebonded) around the inner cup 142A. While a specific embodiment of a container 136 is depicted in FIG. 9, any container configured to support the materials in the desired shape while subjected to the temperatures and pressures of processing may be used.

In some embodiments, the recess 134 may be formed concurrently while the superhard, polycrystalline material 102 is secured to the substrate 108 (see FIG. 1). For example, a precursor material 140 of the superhard, polycrystalline material 102 (see FIG. 1) may be positioned in the inner cup 142A of the container 136. The precursor material 140 may include, for example, particles (e.g., a powder) of a superhard material (e.g., diamond), optionally, particles of a solvent catalyst material (e.g., cobalt), and any other desired material intermixed with the particles of the superhard material. At least one constituent material 138 of the substrate 108 (see FIG. 1) may be placed in the inner cup 142A of the container 136 with the precursor material 140. The constituent material 138 may include, for example, particles of a hard ceramic material (e.g., tungsten carbide), optional particles of a metal or metal alloy matrix material (e.g., cobalt), and any other desired materials. In embodiments where the recess 134 (see FIG. 8) was formed before forming the superhard, polycrystalline material 102 (see FIG. 1), the intermediate structure 132 shown in FIG. 8 may be placed in the container 136 in place of the constituent material 138. In some embodiments, a mass 144 (e.g., a foil or a quantity of powder) of solvent catalyst material (e.g., cobalt) may be interposed between the constituent material 138 and the precursor material 140. The mass 144 may be configured and positioned to infiltrate the precursor material 140 and catalyze formation of intergranular bonds to produce the superhard, polycrystalline material 102 (see FIG. 1).

A blank 146 may be positioned in the inner cup 142A adjacent to the constituent material 138. The blank 146 may be sized, shaped, and positioned to form the recess 134 (see FIG. 8) in the substrate 108 (see FIG. 1). For example, the blank 146 may exhibit an inverse shape of the recess 134 (see FIG. 8), may be longitudinally spaced from the precursor material 140 by a portion of the constituent material 138, and may be located laterally adjacent to another, remaining portion of the constituent material 138. For example, the blank 146 may be embedded within the constituent material 138 with a surface of the blank 146 exposed on a side of the constituent material 138 opposite the precursor material 140. The blank 146 may include an inert material such that the blank 146 may not react with a material of the substrate 108 (see FIG. 1) during formation of the superhard, polycrystalline material 102 (see FIG. 1). For example, the blank 146 may include silica or alumina.

The materials within the container 136 may be subjected to a high-temperature/high-pressure (HTHP) process to form the superhard, polycrystalline material 102 secured to the second region 116 of the substrate 108 (see FIG. 1). For example, the container 136 and its contents may be subjected to a pressure of at least about 5 GPa (e.g., at least about 8 GPa) and may be exposed to a temperature of at least about 1,350° C. (e.g., at least about 1,500° C.). As a result, any solvent catalyst material and matrix material in the container 136 may melt, may catalyze formation of intergranular bonds among particles of superhard material of the precursor material 140, and may bind the particles of hard material of the constituent material 138 to one another to form the superhard, polycrystalline material 102 secured to the second region 116 of the substrate 108 (see FIG. 1). Subsequently, the blank 146 may be removed from the second region 116 (see FIG. 1), for example, by destroying the blank 146. In some embodiments, the resulting recess 134 (see FIG. 8) may then be filled with a first material to form the first region 110 (see FIG. 1). The first material of the first region 110 (see FIG. 1) may exhibit a first, different coefficient of thermal expansion (e.g., a first, lower coefficient of thermal expansion) when compared to the second coefficient of thermal expansion of the second region 116 (see FIG. 1).

Figure 10:
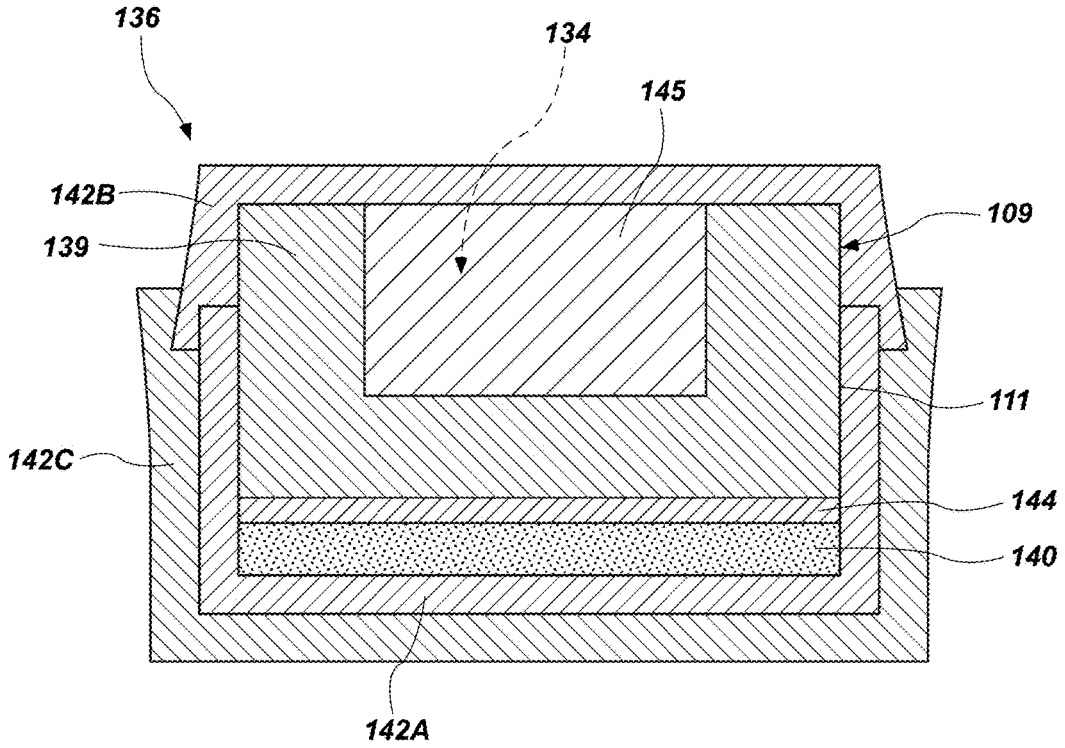
FIG. 10 is a cross-sectional side view of the container for forming a cutting element of FIG. 9.

FIG. 10 is a cross-sectional side view of the container 136 for forming a cutting element 100 (see FIG. 1) of FIG. 9. In some embodiments, such as that shown in FIG. 10, the recess 134 may be formed and filled with the first material to form the first region 110 (see FIG. 1) concurrently while the superhard, polycrystalline material 102 is secured to the substrate 108 (see FIG. 1). For example, a precursor material 140 of the superhard, polycrystalline material 102 (see FIG. 1) may be positioned in the inner cup 142A of the container 136. The precursor material 140 may include, for example, particles (e.g., a powder) of a superhard material (e.g., diamond), optionally, particles of a solvent catalyst material (e.g., cobalt), and any other desired material intermixed with the particles of the superhard material. At least one second constituent material 139 of the substrate 108 (see FIG. 1) may be placed in the inner cup 142A of the container 136 with the precursor material 140. The second constituent material 139 may include, for example, particles of a hard ceramic material (e.g., tungsten carbide), optional particles of a metal or metal alloy matrix material (e.g., cobalt), and any other desired materials. In embodiments where the recess 134 (see FIG. 8) was formed before forming the superhard, polycrystalline material 102 (see FIG. 1), the intermediate structure 132 shown in FIG. 8 may be placed in the container 136 in place of the second constituent material 139. In some embodiments, a mass 144 (e.g., a foil or a quantity of powder) of solvent catalyst material (e.g., cobalt) may be interposed between the second constituent material 139 and the precursor material 140. The mass 144 may be configured and positioned to infiltrate the precursor material 140 and catalyze formation of intergranular bonds to produce the superhard, polycrystalline material 102 (see FIG. 1).

A first constituent material 145 may be positioned in the inner cup 142A adjacent to the second constituent material 139. The first constituent material 145 may be sized, shaped, and positioned to form the first region 110 (see FIG. 1) of the substrate 108 (see FIG. 1). For example, the first constituent material 145 may exhibit an inverse shape of the recess 134 (see FIG. 8), may be longitudinally spaced from the precursor material 140 by a portion of the second constituent material 139, and may be located laterally adjacent to another, remaining portion of the second constituent material 139. For example, the first constituent material 145 may be embedded within the second constituent material 139 with a surface of the first constituent material 145 exposed on a side of the second constituent material 139 opposite the precursor material 140. The first constituent material 145 may include, for example, particles of a hard ceramic material (e.g., tungsten carbide), optional particles of a metal or metal alloy matrix material (e.g., cobalt), and any other desired materials. The second constituent material 139 may be formulated to exhibit a second coefficient of thermal expansion after being processed to form the second region 116 (see FIG. 1), and the first constituent material 145 may be formulated to exhibit a first, different coefficient of thermal expansion (e.g., a first, higher coefficient of thermal expansion) after being processed to form the first region 110 (see FIG. 1).

The materials within the container 136 may be subjected to a high-temperature/high-pressure (HTHP) process to form the superhard, polycrystalline material 102 secured to the second region 116 of the substrate 108 (see FIG. 1) and to form the first region 110 of the substrate 108 longitudinally adjacent to, and laterally surrounded by, the second region 116 (see FIG. 1). For example, the container 136 and its contents may be subjected to a pressure of at least about 5 GPa (e.g., at least about 8 GPa) and may be exposed to a temperature of at least about 1,350° C. (e.g., at least about 1,500° C.). As a result, any solvent catalyst material and matrix material in the container 136 may melt, may catalyze formation of intergranular bonds among particles of superhard material of the precursor material 140, and may bind the particles of hard material of the second and first constituent materials 139 and 145 to one another to form the superhard, polycrystalline material 102 secured to the substrate 108 (see FIG. 1).

Figure 11:
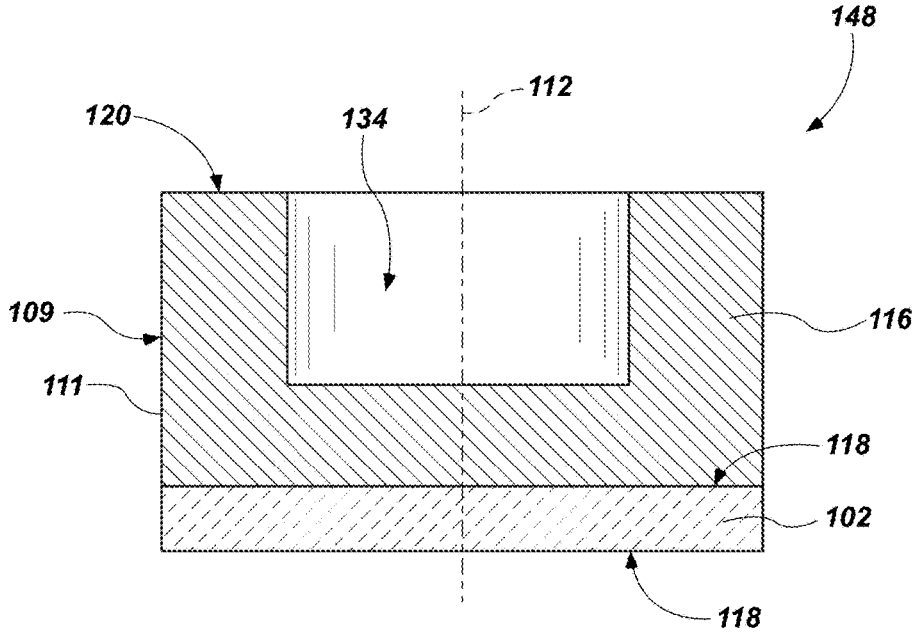
FIG. 11 is a cross-sectional side view of an intermediate structure in a process of forming a cutting element.

FIG. 11 is a cross-sectional side view of an intermediate structure 148 in a process of forming a cutting element 100 (see FIG. 1). In some embodiments, the recess 134 may be formed after the superhard, polycrystalline material 102 is secured to the substrate 108 (see FIG. 1). For example, a cutting element lacking the recess 134 may be formed by performing the actions discussed previously in connection with FIG. 9 without positioning the blank 146 (see FIG. 9) in the container 136, such that the constituent material 138, precursor material 140, and optional solvent catalyst material 144 occupy an entire internal volume of the container 136, and the resulting substrate is a cylinder of at least substantially uniform material composition. The recess 134 may then be formed by removing material from the rearmost surface 120 proximate the longitudinal axis 112. As another example, material removal may be performed after forming the intermediate structure 148 to exhibit a near-net shape. For example, the intermediate structure 148 may initially be formed with a near-net-shape recess to exhibit a near-net shape (e.g., a shape at least substantially similar to that shown in FIG. 11), and some material may subsequently be removed to finalize the recess 134 and intermediate structure 148. The recess 134 may be formed, for example, by electrical discharge machining, laser drilling, or milling material from a cylinder to remove material to define the second region 116 of the substrate 108 (see FIG. 1). In some embodiments, the resulting recess 134 (see FIG. 8) may then be filled with a first material to form the first region 110 (see FIG. 1). The first material of the first region 110 (see FIG. 1) may exhibit a first, different coefficient of thermal expansion (e.g., a first, lower coefficient of thermal expansion) when compared to the second coefficient of thermal expansion of the second region 116 (see FIG. 1).

Figure 12:
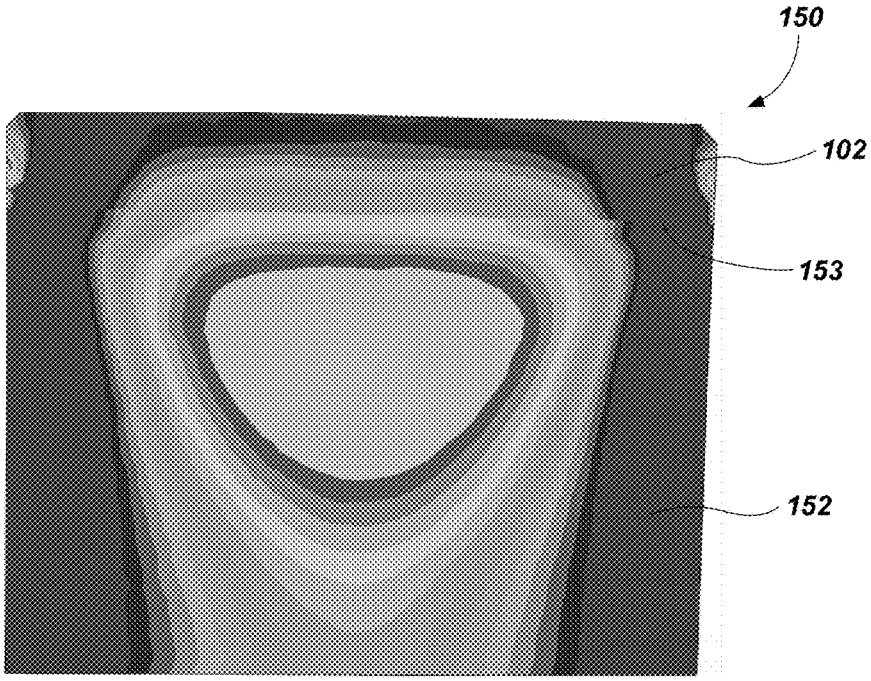
FIG. 12 is a cross-sectional side view of an internal stress state of a conventional cutting element.

FIG. 12 is a cross-sectional side view of an internal stress state of a conventional cutting element 150. The cutting element 150 may include a superhard, polycrystalline material 102 secured to a substrate 152. The substrate 152 may be at least substantially cylindrical and may have an at least substantially uniform material composition. Because of differences between the coefficients of thermal expansion between the superhard, polycrystalline material 102 and the substrate 152, residual stresses may be induced in the cutting element 150 after being exposed to elevated temperatures during HTHP processing and during attachment to an earth-boring tool (e.g., during brazing) and subsequent cooling. As shown in FIG. 11, high residual stresses may be located within the superhard, polycrystalline material 102 and the substrate 152, which residual stresses may extend laterally within the superhard, polycrystalline material 102 across a majority of a surface area of the cutting face 104 and at a lateral periphery of the superhard, polycrystalline material 102. Peak residual stresses within the superhard, polycrystalline material 102 may be concentrated along an interface 153 between the superhard, polycrystalline material 102 and the substrate 152. Such residual stresses may hasten damage to and failure of the cutting element 150.

Figure 13:
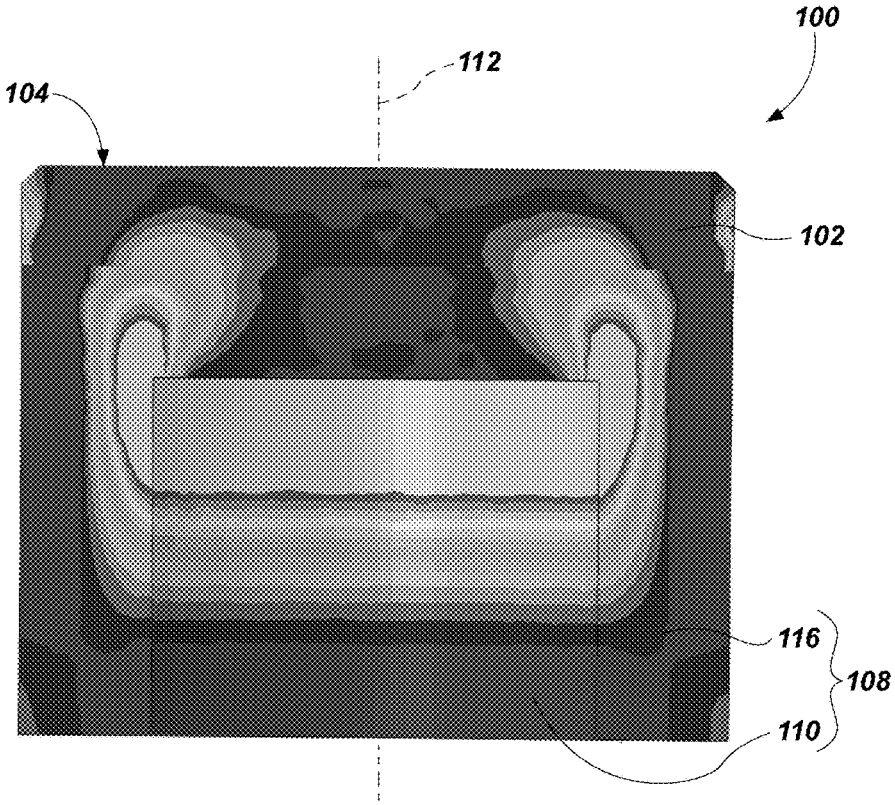
FIG. 13 is a cross-sectional side view of an internal stress state of a cutting element of this disclosure.

FIG. 13 is a cross-sectional side view of an internal stress state of a cutting element 100 of this disclosure. Formation of the recess 134 (see FIGS. 8, 11), positioning a first material exhibiting a first, different coefficient of thermal expansion in the first region 110 when compared to a second coefficient of thermal expansion of the second region 116, or both may reduce the residual stresses within the cutting element 100 when compared to a conventional cutting element 150 (see FIG. 12). As shown in FIG. 13, residual stresses may be particularly reduced within the superhard, polycrystalline material 102 proximate the longitudinal axis 112 and along the interface between the superhard, polycrystalline material 102 and the substrate 108 (e.g., the upper surface 118 of the substrate 108). A maximum stress within the superhard, polycrystalline material 102 may be reduced by, for example, between about 10% and about 40%. More specifically, the maximum stress within the superhard, polycrystalline material 102 may be reduced by, for example, between about 15% and about 35%. As a specific, nonlimiting example, the maximum stress within the superhard, polycrystalline material 102 may be reduced by, for example, between about 20% and about 30%.

Not only may embodiments within the scope of this disclosure reduce the residual stresses within the cutting element 100, but they may also induce a beneficial stress state within the cutting element 100, which may prolong its useful life. For example, cracks may be less likely to form within and propagate through the superhard, polycrystalline material 102 when the superhard, polycrystalline material 102 is in a state of compressive stress, as compared to when the superhard, polycrystalline material 102 is not stressed or in a state of tensile stress. Formation of the recess 134 (see FIGS. 8, 11), positioning a first material exhibiting a first, different coefficient of thermal expansion in the first region 110 when compared to a second coefficient of thermal expansion of the second region 116, or both may relieve tensile stresses within the superhard, polycrystalline material 102, and may induce compressive stresses within the superhard, polycrystalline material 102, which may lead to reduced fracture and spalling, and increased useable lifetimes relative to previously known cutting elements. More specifically, induction of a compressive stress state within the superhard, polycrystalline material 102 may be desirable because it may deflect cracks longitudinally away from a transverse plane extending at least substantially perpendicular to the longitudinal axis 112, which may reduce the likelihood that that spalling will occur.

Figure 14:
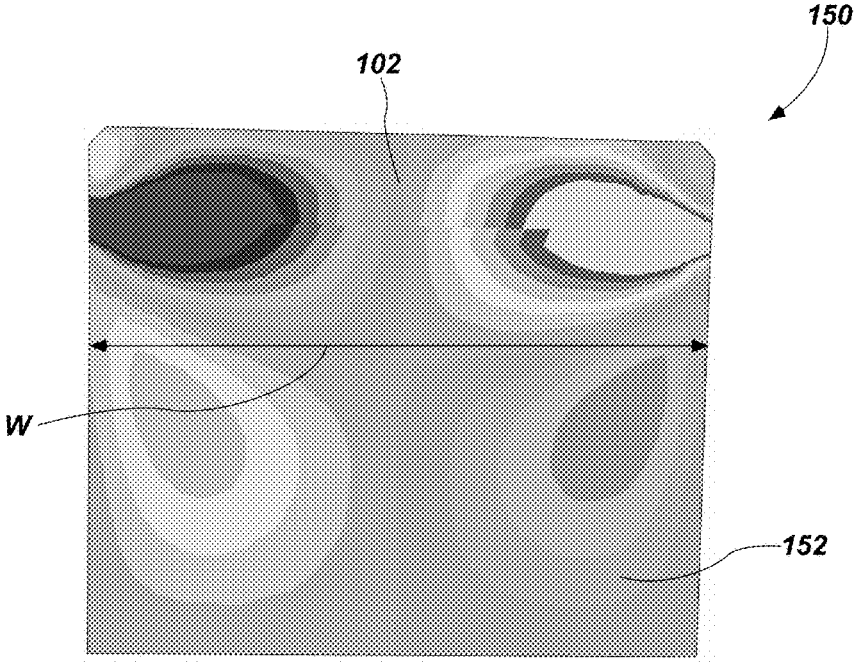
FIG. 14 is a cross-sectional side view of an internal stress state of the conventional cutting element of FIG. 12 when subjected to a shear stress.

FIG. 14 is a cross-sectional side view of an internal stress state of the conventional cutting element 150 of FIG. 12 when subjected to a shear stress. As shown in FIG. 14, high stresses within the superhard, polycrystalline material 102 induced from the combination of residual stress and applied stress may extend from the lateral periphery of the cutting element 150 toward the center. For example, the stresses may remain high across at least 25% of a lateral width W of the substrate 152. More specifically, the stresses may remain high across at least 30% of the lateral width W of the substrate 152. As a specific, nonlimiting example, the stresses may remain high across at least 33% of the lateral width W of the substrate 152.

Figure 15:
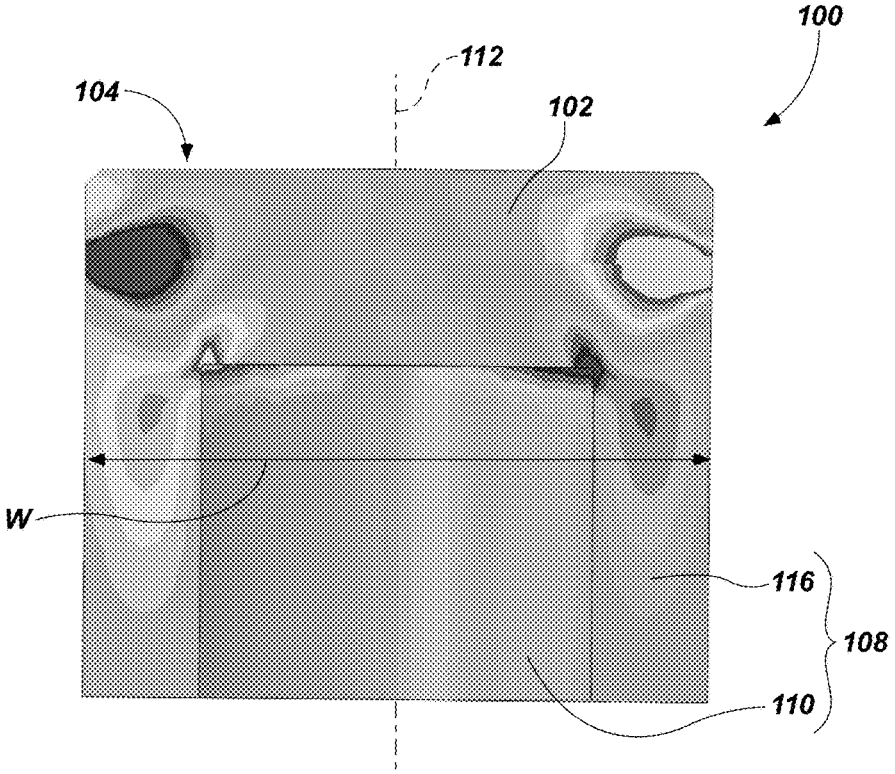
FIG. 15 is a cross-sectional side view of an internal stress state of the cutting element of FIG. 13 when subjected to a shear stress.

FIG. 15 is a cross-sectional side view of an internal stress state of the cutting element 100 of FIG. 13 when subjected to a shear stress. As shown in FIG. 15, stresses within the superhard, polycrystalline material 102 induced from the combination of residual stress and applied stress extending from the lateral periphery of the cutting element 100 toward the longitudinal axis 112 may be reduced when compared to the conventional cutting element 150 (see FIG. 14), particularly within the superhard, polycrystalline material 102. For example, high stresses may only extend across 20% or less of the lateral width W of the substrate 108. More specifically, the stresses may remain high across 18% or less of the lateral width W of the substrate 108. As a specific, nonlimiting example, the stresses may remain high across 15% or less of the lateral width W of the substrate 108.

Figure 16:
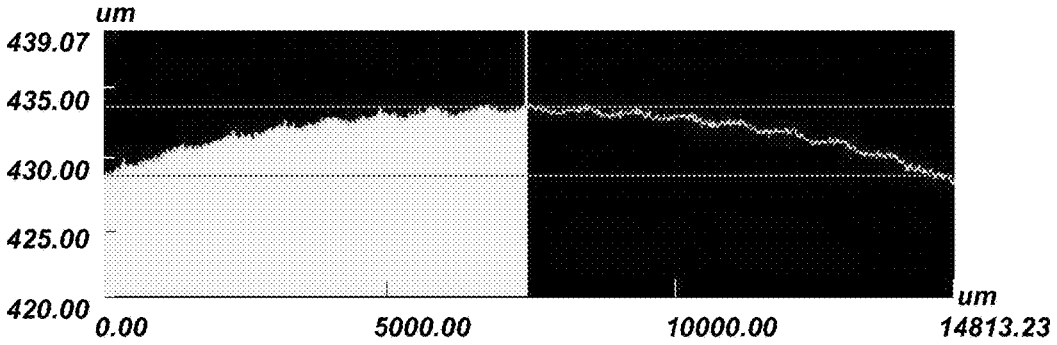
FIG. 16 is a graph of a measured deflection of a cutting face of the cutting element of FIG. 1.

FIG. 16 is a graph of a measured deflection of a cutting face 104 of the cutting element 100 of FIG. 1. An intermediate structure 148 (see FIG. 11) in the process of forming the cutting element 100 (see FIG. 1) was formed, and a strain gauge was placed on the cutting face 104 of the superhard, polycrystalline material 102 to measure deflection of the cutting face 104. When the recess 134 (see FIG. 8) was formed, the cutting face 104 deflected, increasing a convexity of the cutting face 104, which was evidence that the residual stresses had been relieved by deformation of the cutting element 100 (see FIG. 1). A magnitude of a maximum deflection of the cutting face 104 may be, for example, about 1 μm or more. More specifically, the maximum deflection of the cutting face 104 may be, for example, about 2.5 μm or more. As a specific, nonlimiting example, the maximum deflection of the cutting face 104 may be about 5 μm or more.

Figure 17:
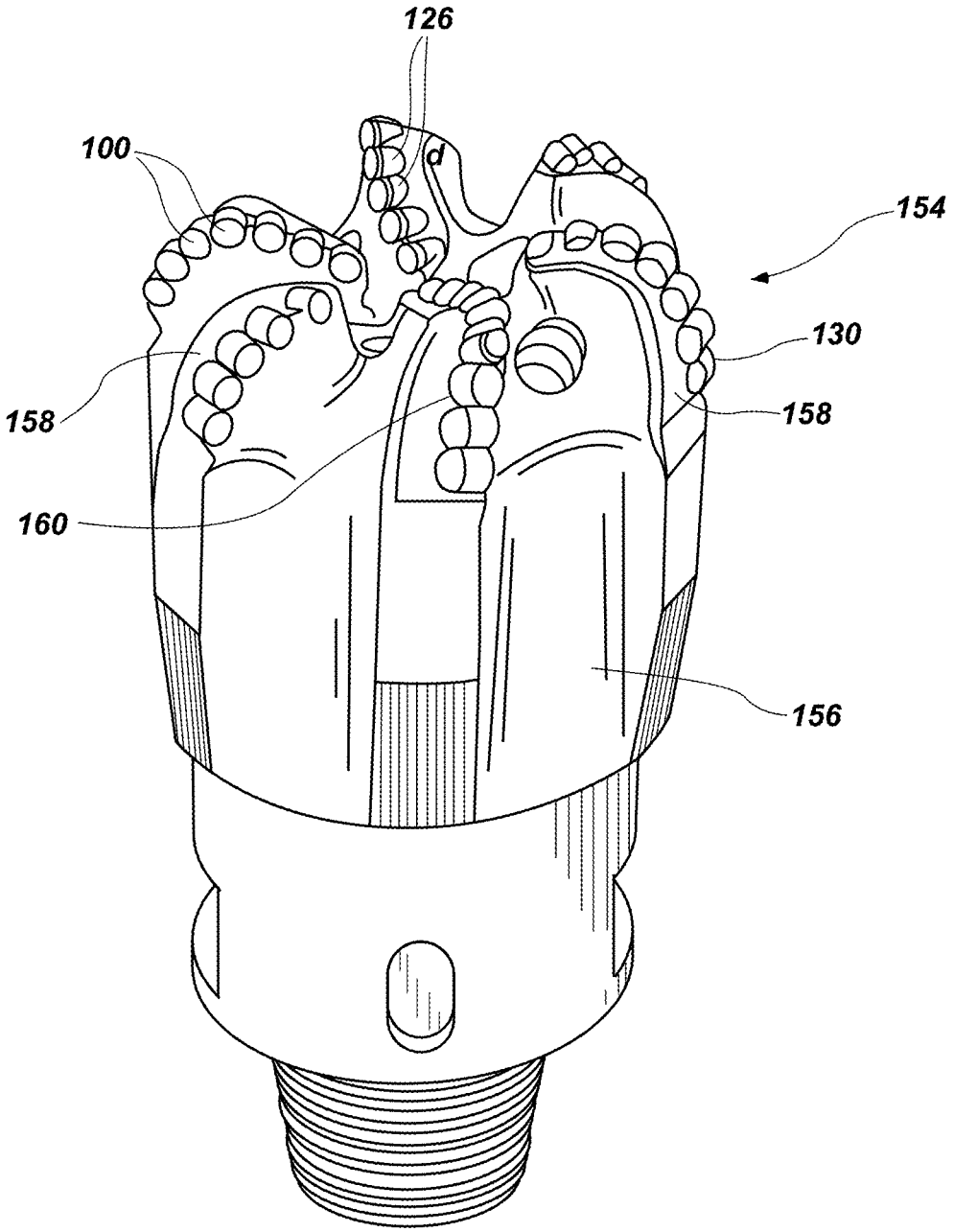
FIG. 17 is a perspective view of an earth-boring tool.

FIG. 17 is a perspective view of an earth-boring tool 154. The earth-boring tool 154 may be depicted as a fixed-cutter earth-boring drill bit, though any other earth-boring tool may be used. At least one cutting element 100, 126, or 130 as described previously may be attached to the earth-boring tool 154. The earth-boring tool 154 may include a body 156 having blades 158 extending outward from a remainder of the body 156. The cutting elements 100, 126, or 130 may be secured within pockets 160 formed in the blades 158.

Figure 18:
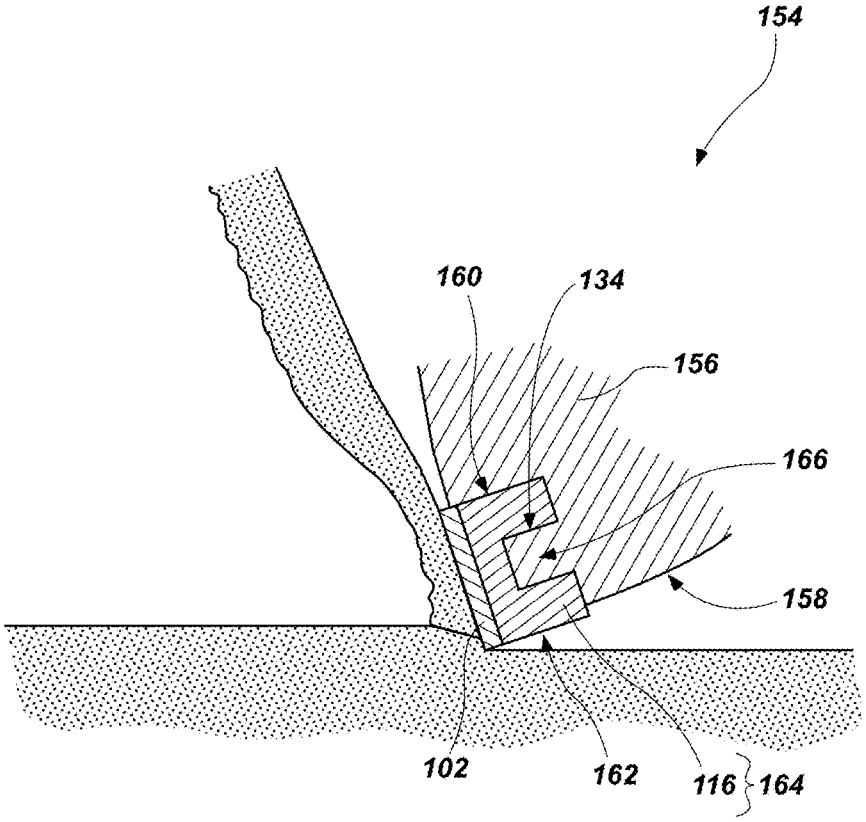
FIG. 18 is a cross-sectional side view of a portion of the earth-boring tool of FIG. 17 during drilling.

FIG. 18 is a cross-sectional side view of a portion of the earth-boring tool 154 of FIG. 17 during drilling. In some embodiments, such as that shown in FIG. 18, cutting elements 162 within the scope of this disclosure may lack the first region 110 (see FIG. 1). Such a cutting element 162 may include the superhard, polycrystalline material 102 and a substrate 164 consisting of the second region 116 as described previously in connection with FIGS. 1 through 7. To adequately support the substrate 164 another structure may be positioned in the recess 134. For example, the earth-boring tool 154 may include a post 166 integral with the body 156 and extending rotationally forward from a rotationally rearmost surface defining the pocket 160. The post 166 may be received in the recess 134, and may exhibit a shape complementary to the recess 134. As another example, a support structure separate from the body 156 of the earth-boring tool 154 may be positioned in the recess 134 before the cutting element 162 is secured within the pocket 160.

While certain illustrative embodiments have been described in connection with the figures, those of ordinary skill in the art will recognize and appreciate that the scope of this disclosure is not limited to those embodiments explicitly shown and described in this disclosure. Rather, many additions, deletions, and modifications to the embodiments described in this disclosure may result in embodiments within the scope of this disclosure, such as those specifically claimed, including legal equivalents. In addition, features from one disclosed embodiment may be combined with features of another disclosed embodiment while still being within the scope of this disclosure, as contemplated by the inventors.

What is claimed is:

1. A cutting element for an earth-boring tool, comprising:
- a superhard, polycrystalline material; and
- a substrate adjacent to and secured to the superhard, polycrystalline material at an interface, the substrate comprising:
  - a first region exhibiting a first coefficient of thermal expansion, the first region spaced from the superhard, polycrystalline material; and
  - a second region exhibiting a second, lesser coefficient of thermal expansion, the second region extending from laterally adjacent to at least a portion of the first region to longitudinally between the first region and the superhard, polycrystalline material.

2. The cutting element of claim 1, wherein the second region laterally surrounds the first region.

3. The cutting element of claim 1, wherein the first region is located within a channel extending laterally through the second region.

4. The cutting element of claim 1, wherein a cross-sectional shape of the first region is circular and a cross-sectional shape of the substrate is circular and wherein a diameter of the first region is between about 50% and about 80% of a diameter of the substrate.

5. The cutting element of claim 1, wherein a first material of the first region is a metal or metal alloy and a second material of the second region is a ceramic-metallic composite material.

6. The cutting element of claim 5, wherein the first material is aluminum, copper, or nickel or a metal alloy comprising aluminum, copper, or nickel.

7. The cutting element of claim 1, wherein a first material of the first region is a ceramic-metallic composite material exhibiting a first weight percentage of ceramic particles and a first weight percentage of metal or metal alloy matrix and a second material of the second region is a ceramic-metallic composite material exhibiting a second, different weight percentage of ceramic particles and a second, different weight percentage of metal or metal alloy matrix.

8. The cutting element of claim 1, wherein a topography of a boundary between the first region and the second region extending laterally is the same as a topography of the interface between the superhard, polycrystalline material and the substrate within a footprint of the boundary.

9. A method of forming a cutting element for an earth-boring tool, comprising:

forming a recess in a substrate at a first region positioned to be spaced from a superhard, polycrystalline material when the superhard, polycrystalline material is adjacent to and secured to the substrate at an interface, to leave a second region of the substrate, the second region extending laterally outward from a longitudinal axis of the substrate and longitudinally toward and laterally adjacent to the first region proximate at least a portion of a periphery of the substrate; and securing the superhard, polycrystalline material to the substrate on a side of the substrate opposite the recess.

10. The method of claim 9, wherein the second region of the substrate exhibits a second coefficient of thermal expansion further comprising positioning a first material in the recess, the first material exhibiting a first, different coefficient of thermal expansion.

11. The method of claim 10, wherein a second material of the second region is a ceramic-metallic composite material exhibiting a second weight percentage of ceramic particles and a second weight percentage of metal or metal alloy matrix and wherein positioning the first material in the recess comprises positioning aluminum, copper, nickel, a metal alloy comprising aluminum, copper, or nickel, or a ceramic-metallic composite material exhibiting a first, different weight percentage of ceramic particles and a first, different weight percentage of metal or metal alloy matrix and in the recess.

12. The method of claim 9, wherein forming the recess in the substrate comprises forming a blind bore in the substrate.

13. The method of claim 12, wherein a cross-sectional shape of the substrate is circular, wherein forming the blind bore in the substrate comprises forming the blind bore to exhibit a circular cross-sectional shape, and wherein forming the blind bore in the substrate comprises forming the blind bore to exhibit a diameter of between about 50% and about 80% of a diameter of the substrate.

14. The method of claim 9, wherein forming the recess in the substrate comprises forming a channel extending laterally through the substrate.

15. The method of claim 9, wherein forming the recess in the substrate occurs after securing the superhard, polycrystalline material to the substrate.

16. The method of claim 15, wherein forming the recess in the substrate comprises removing material of the substrate at the first region to form the recess by at least one of electrical discharge machining (EDM), laser drilling, and milling the first region of the substrate.

17. The method of claim 15, wherein forming the recess in the substrate comprises causing a cutting face of the superhard, polycrystalline material to deflect in response to formation of the recess.

18. The method of claim 9, wherein forming the recess in the substrate occurs before securing the superhard, polycrystalline material to the substrate.

19. The method of claim 18, wherein forming the recess in the substrate comprises:

positioning a plurality of particles of a hard material in a container with a blank structure, the blank structure exhibiting an inverse of a shape of the recess at the first region, the plurality of particles exhibiting a shape of the second region;

binding the plurality of particles with a metal or metal alloy matrix material to form the substrate; and removing the blank structure to form the recess in the substrate.

20. The method of claim 9, wherein forming the recess in the substrate comprises forming a laterally extending surface partially defining the recess to exhibit a topography the same as a topography of a surface of the substrate positioned to form the interface between the superhard, polycrystalline material and the substrate within a footprint of the laterally extending surface partially defining the recess.

* * * * *